US009325074B2

(12) United States Patent
Chandler

(10) Patent No.: US 9,325,074 B2
(45) Date of Patent: Apr. 26, 2016

(54) COAXIAL WAVEGUIDE ANTENNA

(75) Inventor: Charles Chandler, Goleta, CA (US)

(73) Assignee: RAYTHEON COMPANY, Waltham, MA (US)

( * ) Notice: Subject to any disclaimer, the term of this patent is extended or adjusted under 35 U.S.C. 154(b) by 835 days.

(21) Appl. No.: 13/303,550

(22) Filed: Nov. 23, 2011

(65) Prior Publication Data

US 2013/0127678 A1 May 23, 2013

(51) Int. Cl.
*H01Q 13/00* (2006.01)
*H01Q 13/08* (2006.01)
*H01Q 23/00* (2006.01)

(52) U.S. Cl.
CPC ..... *H01Q 13/08* (2013.01); *H01Q 23/00* (2013.01)

(58) Field of Classification Search
CPC ..... H01Q 23/00; H01Q 13/08
USPC ..... 343/770, 771, 772, 777, 778, 853, 731
See application file for complete search history.

(56) References Cited

U.S. PATENT DOCUMENTS

| | | | | |
|---|---|---|---|---|
| 4,041,499 A | | 8/1977 | Liu et al. | |
| 4,443,804 A | | 4/1984 | Smith | |
| 5,162,803 A | * | 11/1992 | Chen | 342/372 |
| 5,369,367 A | * | 11/1994 | Eisenhart | 324/632 |
| 5,920,240 A | * | 7/1999 | Alexanian et al. | 333/127 |
| 7,215,220 B1 | * | 5/2007 | Jia | 333/125 |
| 7,312,751 B1 | * | 12/2007 | Voyce et al. | 342/380 |
| 7,400,215 B2 | * | 7/2008 | Deckman et al. | 333/125 |
| 2003/0146807 A1 | | 8/2003 | Higgins | |
| 2006/0202777 A1 | * | 9/2006 | Deckman et al. | 333/125 |

FOREIGN PATENT DOCUMENTS

EP 0556941 A1 8/1993

OTHER PUBLICATIONS

CAP Wireless; CAP Notes; CAP Note 990056; Rev 1; pp. 1-4.

(Continued)

*Primary Examiner* — Dieu H Duong
(74) *Attorney, Agent, or Firm* — Burns & Levinson LLP; Joseph M. Maraia

(57) ABSTRACT

Processes and systems for radiating electromagnetic energy from an open-ended coaxial cavity are described herein. An antenna assembly includes an open-ended coaxial radiator. The coaxial assembly includes an inner electrically conducting surface and an outer conductive surface spaced apart from and opposing the inner electrically surface. More than one radially aligned electromagnetic coupling modules are positioned at least partially within the coaxial waveguide along different rotation angles. Each of the different electromagnetic coupling modules samples a local electric field, amplifies the sampled field, and alters a phase of at least one of the amplified fields. The amplified, phase-adjusted coaxial fields are radiated from an open end of the coaxial cavity. Although described for transmission mode, the structure can be operated in receive mode by similarly detecting radiated electric fields, amplifying and applying a phase offset, and radiating the amplified, phase offset fields into an open-ended coaxial cavity.

20 Claims, 12 Drawing Sheets

(56) References Cited

OTHER PUBLICATIONS

Herschmann et al.; Radiation Characteristics of a Coaxial Waveguide with Eccentric Inner Conductor for Application in Hyperthermia and Microwave Reflex Therapy; Advances in Radio Science; vol. 5; 2007; pp. 189-195.

Jerby et al.; The Microwave Drill; Science Magazine; vol. 298; Oct. 18, 2002; pp. 587-589.

Herscovici; Extremely Wide-Band Antennas for Wireless Communication; www.fortunecity.com; last viewed Feb. 9, 2012.

* cited by examiner

COAXIAL WAVEGUIDE ANTENNA

TECHNICAL FIELD

Various embodiments are described herein relating generally to antennas and the like, and more particularly to antennas incorporating a radiating coaxial waveguide.

BACKGROUND

Coaxial transmission lines or waveguides are widely recognized as efficient media for transferring electrical signals. Their desirable properties include broad bandwidth and relatively low power loss. Such properties result, at least in part, from the fundamental structure of these media. Coaxial transmission lines or waveguides include an inner or center conductor and outer conductor, sometimes referred to as a shield or wall. Electrical signals can be driven between the inner and outer conductors. Beneficially, the coaxial structure supports the transfer of low frequencies lending towards its broad bandwidth properties. A region between the conductors can be filed by one or more dielectrics, such as air or a vacuum. Electromagnetic radiation is generally confined to this region inside the waveguide, sometimes referred to as "shield effect." Thus, the transmission of energy in the waveguide occurs through the dielectric inside the waveguide, between the inner and outer conducting surfaces. In radio-frequency applications, for example up to a few gigahertz, the wave propagates primarily in the transverse electromagnetic (TEM) mode, with the electric and magnetic fields both substantially perpendicular to the direction of propagation, which is generally along a central axis. Above a certain cutoff frequency, however, transverse electric (TE) and/or transverse magnetic (TM) higher order modes can also propagate, as they do in a hollow waveguide.

Most of the shield effect in such coaxial waveguides results from opposing currents between an outer surface of the center conductor and an inner surface of the opposing outer conductor, or shield, creating opposite magnetic fields that cancel, and thus do not radiate. Additionally, for circular coaxial transmission line, the electric field is radially symmetric about the center conductor. Electric field lines diametrically opposed from each other would thus be 180 degrees out of phase with respect to each other. Consequently, for an open-ended coaxial waveguide or cable, any radial portion of the electric field exposed to the open end would cancel with its opposing radial portion of the electric field, thus precluding the possibility of far-field radiation. It is just such features effectively preventing radiation from coaxial waveguide structures that contribute to their effectiveness as energy transfer media.

Radiating or "leaky cable" is another form of coaxial waveguide that is constructed with tuned slots cut into the outer shield. These slots are tuned to the specific radio frequency (RF) wavelength of operation or tuned to a specific radio frequency band. This type of cable is used to provide a tuned bi-directional "desired" leakage effect between transmitter and receiver. It is often used in elevator shafts, underground, transportation tunnels and in other areas where other forms of antennas are not feasible. The direction of radiation is broadside to a central axis of the coaxial waveguide and can vary depending on such features of spacing.

SUMMARY

An antenna assembly includes a coaxial waveguide having an input portion axially disposed opposite an open-ended output. The coaxial waveguide supports the transmission of an electromagnetic wave, for example, from the input toward the open-ended output. The coaxial waveguide further includes a radially distributed array of electromagnetic coupling modules. The coupling modules are disposed at least partially within an open space defined between inner and out conductors of the coaxial waveguide. Each of the electromagnetic coupling modules includes a pair of opposing transducers, aligned axially with respect to the coaxial waveguide. An input-facing one of the opposing of the pair positioned to receive an impinging electromagnetic field. Each of the input-facing ones of the pairs of transducers produces a respective voltage and/or electrical current in response to the electromagnetic field. A respective electronic circuit provides amplification between each of the pairs of transducers, with at least one of the electronic circuits including a phase-adjusting element.

One aspect of an antenna assembly features an open-ended coaxial cavity configured to support transverse electro-magnetic (TEM) wave propagation. The antenna assembly includes an open-ended coaxial waveguide, including an inner electrically conducting surface having a substantially uniform cross section extending along a central axis and an outer electrically conducting surface having a substantially uniform cross section extending along the central axis. The outer conductive surface is spaced apart from and opposing the inner electrically conducting surface. The antenna assembly also includes a first electromagnetic coupling module disposed at least partially within the coaxial waveguide and aligned substantially along a radius and a second electromagnetic coupling module disposed at least partially within the coaxial waveguide and aligned substantially along a different radial direction. Each of the first and second electromagnetic coupling modules includes a respective pair of opposing transducers. Each of the transducers is adapted to convert between an electromagnetic field and at least one of a voltage and a current. Each of the coupling modules also includes a respective electronic circuit in electrical communication between the respective pair of opposing transducers. At least one of the respective electronic circuits includes a phase-adjusting element adapted to introduce a phase difference between the at least one of a voltage and a current of the first and second electromagnetic coupling modules.

In some embodiments, the first and second electromagnetic coupling modules are disposed along diametrically opposing radii and the phase adjusting element introduces a phase difference of +/−180 degrees. In some embodiments, each of the transducers comprises a finline structure adapted for efficiently coupling a radial component of an electric field. In some embodiments, each of the transducers is selected from the group consisting of: dipoles; loops; finlines; antipodal finlines; notch; travelling wave structures; and combinations thereof.

In some embodiments, the antenna assembly further includes third and fourth electromagnetic coupling modules, each disposed at least partially within the coaxial waveguide and along diametrically opposing radii, arranged orthogonal to diametrically opposing radii of the first and second electromagnetic coupling modules. Each of the third and fourth electromagnetic coupling modules includes a respective pair of opposing transducers, each adapted to convert between an electromagnetic field and at least one of a voltage and a current. Each module also includes a respective electronic circuit in electrical communication with the respecting pair of transducers. At least one of the respective electronic circuits includes a phase adjusting element introducing a +/−180 degree phase difference between at least one of a voltage and a current of the third and fourth electromagnetic coupling modules.

In some embodiments, each phase adjusting element introduces a +/90 degrees phase difference between the respective at least one of a voltage and a current of radially adjacent ones of the electromagnetic coupling modules.

In some embodiments, at least one of the electronic circuits includes a respective amplifier adapted to amplify a respective one of the at least one of a voltage and a current.

In some embodiments, the antenna assembly further includes a coaxial transmission line port axially aligned with the coaxial waveguide, and an axially aligned, tapered coaxial waveguide coupled between one end of the open-ended coaxial waveguide and the coaxial transmission line port.

In some embodiments, a cross section of the open-ended coaxial cavity is substantially circular.

In some embodiments, the phase-adjusting element is selected from the group consisting of: reactance-based phase shifters; switched-line phase shifters; vector-modulator-based phase shifters; digital phase shifters; and combinations thereof.

In some embodiments, the open end of the coaxial waveguide is blunt, being defined substantially in a plane perpendicular to the central axis.

In some embodiments, the antenna assembly further includes an axial protrusion of the inner conducting surface extending beyond a terminal end of the outer conducting surface.

In some embodiments, a shape of the protrusion is selected from the group of shapes consisting of: cylinders; cones; paraboloids; truncated cones; truncated paraboloids; prisms; pyramids; and combinations thereof.

Another aspect of an antenna features a process for efficiently radiating from the coaxial waveguide at least a portion of the transverse electro-magnetic (TEM) wave energy. Such a process includes amplifying selectively a first radial component of a transverse electromagnetic field within an open-ended coaxial waveguide. A second radial component of the transverse electromagnetic field, angularly offset from the first radial component is selectively amplified. A relative phase offset is applied between the first and second amplified radial components of the transverse electromagnetic field. Each of the amplified radial components is directed toward an open end of the open-ended coaxial waveguide, wherein the amplified radial components establish far-field radiation.

In some embodiments, the first and second radial components are selected along diametrically opposing radii, and application of a relative phase offset includes applying a +/−180 degree offset between the first and second amplified radial components.

In some embodiments, the process includes amplifying selectively a third radial component of the transverse electromagnetic field angularly offset from the first and second radial components. A fourth radial component of the transverse electromagnetic field angularly offset from the first, second and third radial components is selectively amplified. A relative phase offset is applied between the third and fourth amplified radial components of the transverse electromagnetic field. Each of the amplified radial components is directed toward an open end of the open-ended coaxial waveguide, wherein the amplified radial segments establish far-field radiation In some embodiments, the third and fourth radial components are selected along diametrically opposing radii, and a relative phase offset comprises applying a +/−180 degree offset is applied between the first and second amplified radial components.

In some embodiments, the act of applying the relative phase difference between the first and second electromagnetic coupling modules and application of the relative phase difference between the third and fourth electromagnetic coupling modules, includes applying a relative phase difference between the first and the third electromagnetic coupling modules of approximately +/−90 degrees.

Yet another aspect of an antenna assembly features means for amplifying selectively a first radial component of a transverse electromagnetic field within an open-ended coaxial waveguide; means for amplifying selectively a second radial component of the transverse electromagnetic field, angularly offset from the first radial component; means for applying a relative phase offset between the first and second amplified radial components of the transverse electromagnetic field; and means for directing each of the amplified radial components toward an open end of the open-ended coaxial waveguide, wherein the amplified radial components establish far-field radiation.

Other aspects and advantages of the current invention will become apparent from the following detailed description, taken in conjunction with the accompanying drawings, illustrating the principles of the invention by way of example only.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Described herein are embodiments of systems and techniques related to antenna assemblies including an open-ended, coaxial waveguide. In particular, electromagnetic waves directed axially along a coaxial guided wave structure are coupled to multiple electronic modules, for example, through a spatial feed arrangement, in which the modules are arranged along different radii within the annular cavity of the coaxial waveguide. Each module includes an input portion adapted to couple energy from incident electromagnetic waves at its respective radii module. The incident electromagnetic waves can include information, for example, in the form of any suitable modulation (e.g., amplitude, frequency, phase, and combinations thereof).

Within each module, the coupled energy is converted to a voltage and/or a current, which can be further adjusted by a respective amplitude and/or phase offset. For example, the module can include one or more of an amplifier and a phase adjusting element. Each module further includes an output portion adapted to launch an electromagnetic waves that give rise to far field radiation. In some embodiments, such output waves are coupled back into the coaxial cavity, propagating towards an open end of the cavity. One or more of the amplitude, phase and orientation of each of the different output waves allow the waves to interact constructively, thereby forming a radiating mode of operation. In at least some embodiments, such modes of operation can also include impressed information (e.g., by preserving any modulation of the incident waves) and multimode operation, e.g., $TE_{nm}$ and $TM_{nm}$.

In at least some embodiments, coaxial waveguides as described herein are typically oversized, having increased radial dimensions to accommodate electronics modules of the spatial feed arrangement. The assembly can include or otherwise be used with a tapered or transition coaxial guided wave structure having a tapered inner conductor and a tapered outer conductor that together transition a relatively small coaxial waveguide (e.g., standard coaxial cables, such as RG-6, RG-8, RG-62, RG-214, and the like) to the oversized structure.

Figure 1:
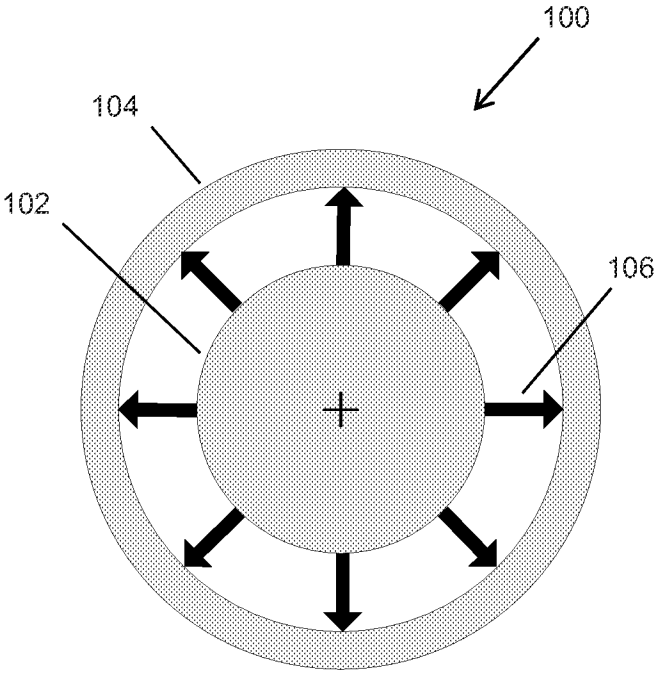
PRIOR ART FIG. 1
FIG. 1 illustrates a cross section of an example of a coaxial waveguide or transmission line, showing the direction of the electric field being propagated.

FIG. 1 illustrates a cross section of an unmodified a coaxial waveguide 100. The coaxial waveguide 100 includes a center conductor 102, such as a wire or cylinder and an outer conductor, or shield 104. The shield 104 is spaced apart from the center conductor 102 defining an open region therebetween. When coaxial waveguide 100 is driven with a time varying signal, it sets up an electromagnetic field between the center conductor 102 and the shield 104 that, according to transmission line theory, direct axial transmission of energy along the waveguide 100. In this example, the electric field portion of a TEM wave is illustrated by radial electrical field 106, illustrated as arrows extending from the center conductor 102 to the shield 104. The electric field is time varying, such that at different times the relative magnitude and direction of the arrows will vary.

Figure 2:
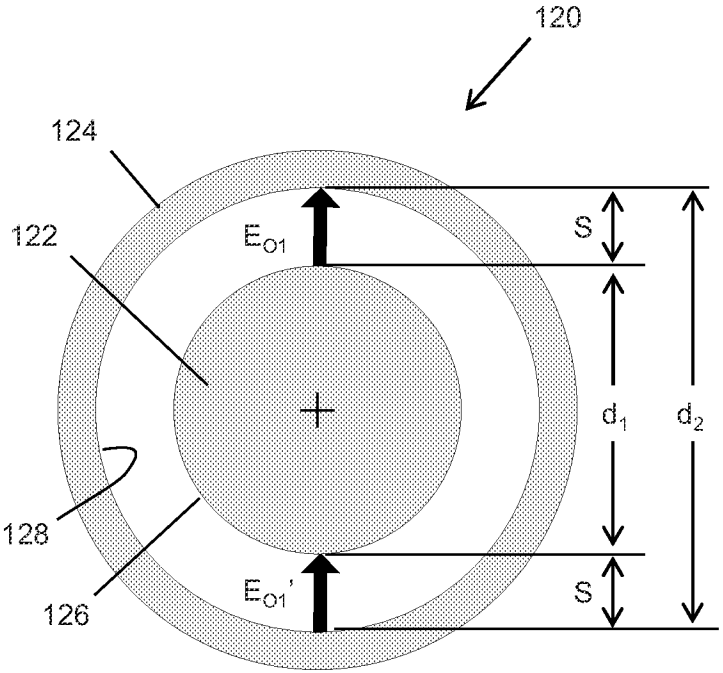
FIG. 2 illustrates an end view of an embodiment of an open-ended, radiating coaxial waveguide.

FIG. 2 illustrates an end view of an embodiment of an open-ended, radiating coaxial waveguide. 120. As with the unmodified waveguide 100, the open-ended coaxial waveguide 120 includes a center conductor 122 and an outer conductor or shield 124. In the illustrative example, the center conductor 122 has a circular cross section with an outer diameter $d_1$. The shield 124 has a circular cross section with an inner diameter $d_2$. The outer diameter of the center conductor $d_1$ is less than the inner diameter of the outer shield $d_2$, such that they are separated from each other by a distance S when centered about a common axis. At least an outer surface 126 of the center conductor 122 and an inner surface 128 of the outer shield 124 are electrically conducting. Conducting surfaces can be provided by solid conducting members, hollow conducting members, insulating members with a conducting coating, and any such combination. The conductors can include high conductivity metals, such as silver, copper, gold, aluminum, zinc, nickel, iron, platinum, lead, and metal alloys, such as brass, bronze, steel, stainless steel, and the like, and other conductive materials, such as carbon nanotubes and conductively plated plastics.

In the illustrative example, the coaxial waveguide 120 is viewed from an axial direction into an open end. This may be an end view, or a cross sectional view taken near the open end. A first electric field $E_{O1}$ is located at a twelve o'clock position. The electric field $E_{O1}$ is directed outward from the central axis. A second electric field $E_{O1}'$ is located in diametric opposition at the six o'clock position, but directed inward, toward the central axis. The coaxial waveguide 120 is specially configured to produce such an arrangement of opposing, aligned electric fields as will be described in more detail below. In such a configuration, the electric fields $E_{O1}$, $E_{O1}'$ are diametrically opposing, but in-phase (i.e., the tips of the arrows are aligned and pointing in the same direction). When such electric fields are allowed to exit the open end of the coaxial waveguide 120, they interact constructively to reinforce the electric field at a far field point rather than cancelling as would opposing fields of the typical unmodified coaxial waveguide 100 (FIG. 1).

Figure 3:
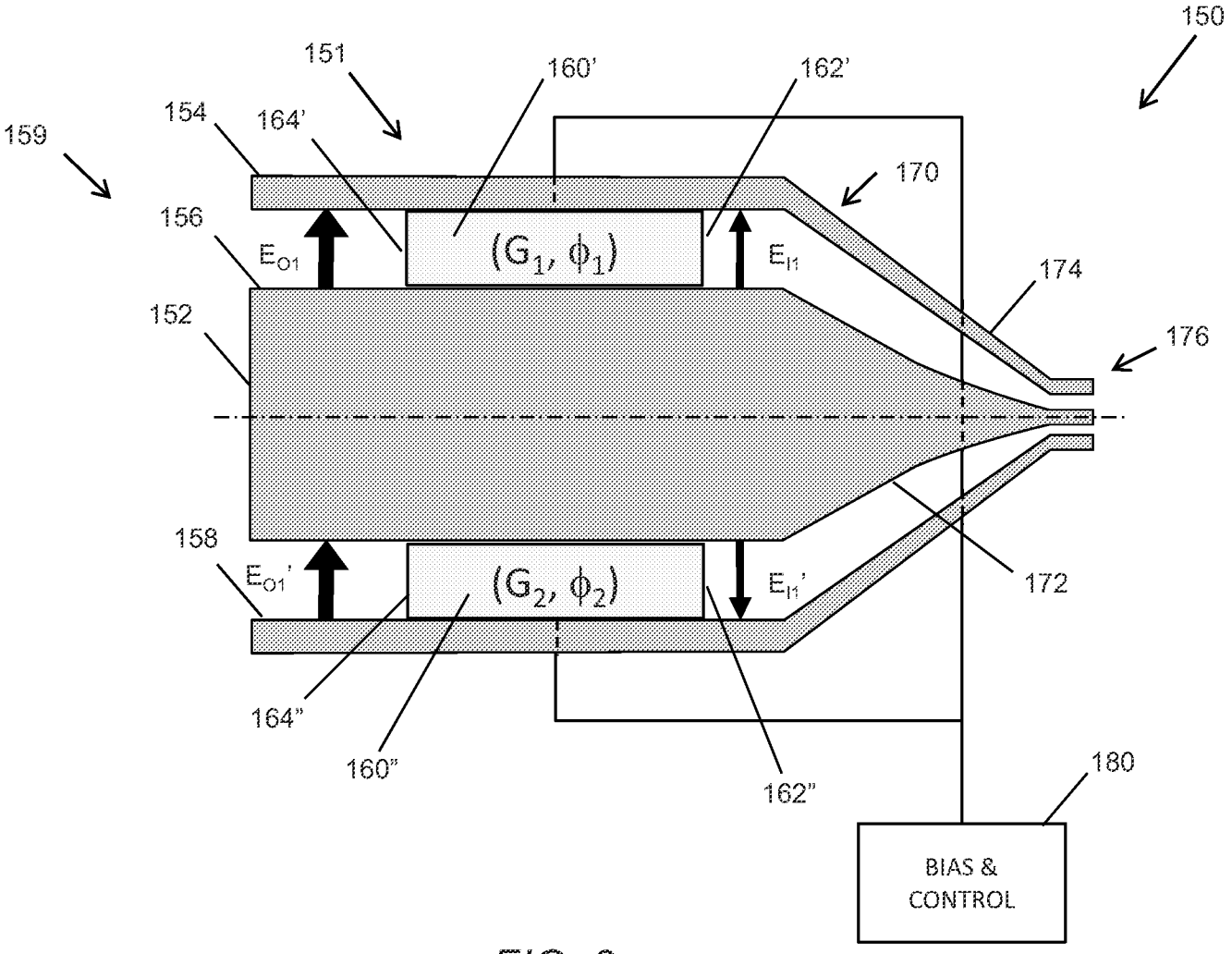
FIG. 3 illustrates a longitudinal cross-section of an embodiment of an open-ended, radiating coaxial waveguide.

FIG. 3 illustrates a longitudinal cross-section of an embodiment of an open-ended, radiating coaxial waveguide assembly 150. The waveguide assembly 150 includes a coaxial waveguide portion 151 extending along a central axis, having a center conductor 152 and an outer conductor or shield 154. The waveguide portion 151 terminates at one end in an open end 159. The open end exposes the space between the conductors 152, 154. In the illustrative example, the termination occurs in blunt fashion, in a plane orthogonal to the central axis. At least an outer surface 156 of the center conductor 152 and an inner surface 158 of the outer shield 154 are electrically conducting.

The waveguide assembly 150 also includes a pair of electromagnetic coupling modules 160', 160" (generally 160) positioned at least partially between the outer and inner electrically conducting surfaces 156, 158. Each of the modules 160 is configured for receiving an electric field from the coaxial cavity at one end (e.g., $E_{I1}$, $E_{I1}'$) and launching an electric field into the coaxial cavity at an opposite end (e.g., $E_{O1}$, $E_{O1}'$). The coupled input electric field gives rise to a current and/or a voltage that may be processed by an electronic circuit, the processed value(s) of the current and/or the voltage used to generate the output electric field. In the illustrative example, these coupling modules 160 reside completely within the coaxial waveguide portion 151, recessed an axial distance from the open end. In addition to coupling electric fields, at least one of the coupling modules 160', 160" includes a phase-adjusting circuit, such that the coupled electric field of each coupling module of the pair of coupling modules 160', 160" differs in phase with respect the other by approximately +/−180 degrees.

In more detail, the first electromagnetic coupling module 160' is located in respective region of the coaxial waveguide portion 151 (e.g., at a twelve o'clock position when viewed from the open end). To the right of the coupling modules 160', 160" the coaxial waveguide 151 supports TEM wave propagation. A portion of the electric field in the upper region of the coaxial waveguide portion 151 is illustrated by an arrow labeled $E_{I1}$. Likewise, a second electromagnetic coupling module 160" is located in a different region of the coaxial waveguide portion 151 (e.g., at a six o'clock position when viewed from the open end). The coupling modules can reside at common axial positions, as shown, but along different radial directions. A portion of the electric field to the right of the second module 160" is illustrated by the arrow labeled and $E_{I1}'$. As illustrated, each of the electric fields $E_{I1}$, $E_{I1}'$ is directed radially outward from the central axis, as with an unmodified coaxial cavity.

In at least some embodiments, the waveguide assembly 150 includes a transitional or tapered coaxial waveguide 170. The tapered waveguide 170 includes a tapered center conductor 172 and a tapered outer conductor or shield 174. One end of the tapered coaxial waveguide 170 is dimensioned to match an adjacent end of the coaxial waveguide portion 151, such that dimensions of an adjacent end of the tapered center conductor 172 substantially match those of the center conductor 152 and dimensions of an adjacent end of the outer conductor 174 substantially match those of the outer shield 154. An opposite end of the tapered waveguide 170 terminates at a coaxial port 176. For example, the coaxial port 176 can include a standard coaxial connector, such as a Type N, BNC, TNC, UHF, and precision connectors, such as APC-7. In some embodiments, the coaxial port 176 includes miniature types of coaxial connectors, such as miniature BNC, IPX, SMZ, SMC, and the like. In yet other embodiments, the coaxial port 176 includes sub-miniature types of coaxial connectors, such as MCX, FME, SMA, SMB, SMC, SMP and the like.

A signal source, such as a radio transmitter (not shown) can be coupled to the waveguide assembly 150, for example, through the coaxial port 176. An output signal of the radio transmitter (e.g., output currents) can give rise to the TEM wave propagation within the transitional waveguide 170 as described herein and ultimately to the coaxial waveguide portion 151, providing the electric fields $E_{I1}$, $E_{I1}'$ at the input end of the coupling modules 160', 160". It is understood that such driving signals can be modulated by any suitable technique to include information and that such modulated signals can give rise to electric fields including such information. When operated in a receive mode of operation, the transmitter would be replaced by a receiver, or in a dual mode (transmit/receive), by a transceiver.

In operation, the first coupling module 160' couples at least a portion of the coaxial electric field $E_{I1}$ adjacent to one end 162'. The coupling module 160' converts the coupled portion of the electric field to at least one of a voltage and a current signal. The coupling module 160' also amplifies the at least one of the voltage and the current signal (e.g., by a first gain value $G_1$) and couples the amplified signal back to an electric field $E_{O1}$ at an opposite end 164' of the coupler 160'. Likewise, the second coupling module 160" couples at least a portion of the electric field $E_{I1}'$ adjacent to at one end 162". The second coupling module 160" similarly converts the coupled portion of the electric field to at least one of a voltage and a current signal. At least one of the first and second coupling modules 160', 160" adds a phase offset (e.g., $\phi_1$, $\phi_2$) to the signal (in the illustrative example, the relative phase offset between both modules is +/−180 degrees). The second coupling module 160" similarly amplifies the phase adjusted signal (e.g., by a first gain value $G_2$) and couples the amplified signal back to an electric field $E_{O1}'$ at an opposite end 164" of the coupler 160". Whereas the coupled electric fields $E_{I1}$, $E_{I1}'$ diametrically oppose each other within the coaxial cavity, the output electric fields $E_{O1}$, $E_{O1}'$ are substantially aligned as a result of the applied phase shift. The relative phase shift (e.g., +/−180 degrees) can be applied entirely by either coupling module, or shared proportionally by both modules.

In the illustrative example, the output electric fields $E_{O1}$, $E_{O1}'$ propagate away from their respective coupling modules 160', 160" and towards an open end 159 of the coaxial waveguide assembly 150. Upon reaching the open end, the electric fields $E_{O1}$, $E_{O1}'$ extend outward from the open end 159, giving rise to radiated fields propagating away from the open end 159. Advantageously, the radiated electric fields no longer cancel each other as they have been aligned by phase adjustments introduced by the coupling modules 160', 160". In at least some embodiments, the radiated electric fields combine in a constructive manner to enhance radiation gain or directivity of a far-field radiation pattern of the coaxial waveguide assembly 150.

A second electric field $E_{O1}'$ is located at the six o'clock position, directed inward toward the central axis. Thus, the electric fields are diametrically opposing, but in-phase (i.e., the tips of the arrows are aligned and pointing in the same direction). When such electric fields are allowed to exit the open end of the coaxial waveguide, they will no longer cancel as would opposing fields of the typical unmodified coaxial waveguide 100 (FIG. 1). Rather, the aligned electric fields can add together constructively at a far field point external to the open end 159 of the assembly 150, supporting far-field radiation. In at least some embodiments, one or more of the coupling modules 160 can be in communication with a processing module, such as a biasing and control module 180. Such processing and control can be used for one or more of establishing modes of operation between, for example, transmit and receive, adjusting gain levels, adjusting phasing (e.g., beam steering) and polarization.

Figure 4:
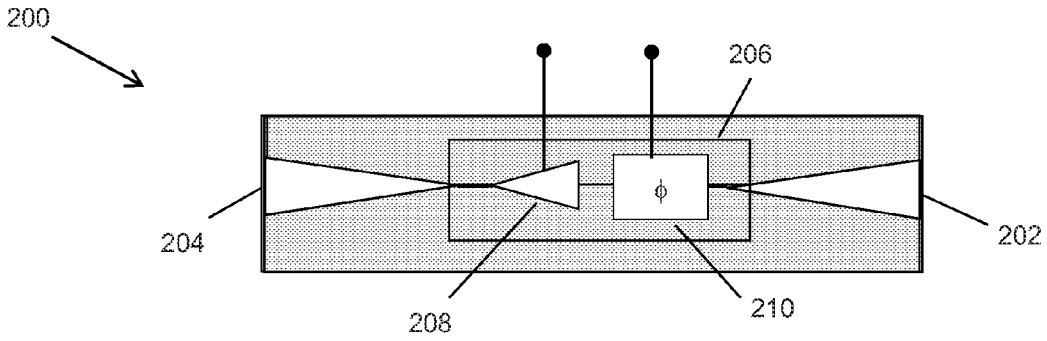
FIG. 4 illustrates a schematic diagram of an embodiment of an electromagnetic coupling module.

FIG. 4 illustrates a schematic diagram of an embodiment of an electromagnetic coupling module 200, such as may be used for the modules 160', 160" (FIG. 3). The coupling module 200 includes a first transducer 202 adapted to convert an electric field to at least one of a voltage signal and a current signal. The first transducer 202 can be configured to face along an axial direction of the coaxial cavity. The coupling module 200 includes a second transducer 204 adapted to convert the at least one of a voltage signal and a current signal to an electric field. The second transducer 204 can be configured to face along an opposite axial direction of the coaxial cavity. The transducers 202, 204 have one end adapted to interface with an electromagnetic field (e.g., with one or more of an electric and magnetic field) and another end adapted to interface with an electronic circuit (e.g., with one or more of a voltage and a current).

Broadband waveguide to electronic circuit board transition, include structures such as microstrip (e.g., a typically flat electrical conductor separated from a ground plane by a dielectric layer), stripline (e.g., typically flat electrical conductor sandwiched between two parallel ground planes separated by a dielectric layer) and other variations of printed circuit board devices. One such structure is generally known as an antipodal finline structure coplanar waveguide.

In at least some embodiments, the coupling module 200 also includes an electronic circuit 206. The circuit 206 is provided in electrical communication between the first and second transducers 202, 204. In the illustrative embodiment, the electronic circuit 206 includes one or more of an amplifier 208 and a phase shifting device 210.

For example, the phase shifting device 210 receives at least one of the voltage signal and the current signal from the first transducer 202 and applies a phase shift (e.g., +/−90 degrees, +/−180 degrees) to the signal(s). The amplifier 206 receives the phase shifted signal(s) and applies gain, thereby amplifying the signal(s). The second transducer 204 receives the phase-shifted, amplified signal(s) and converts it back to an electric field.

Figure 5:
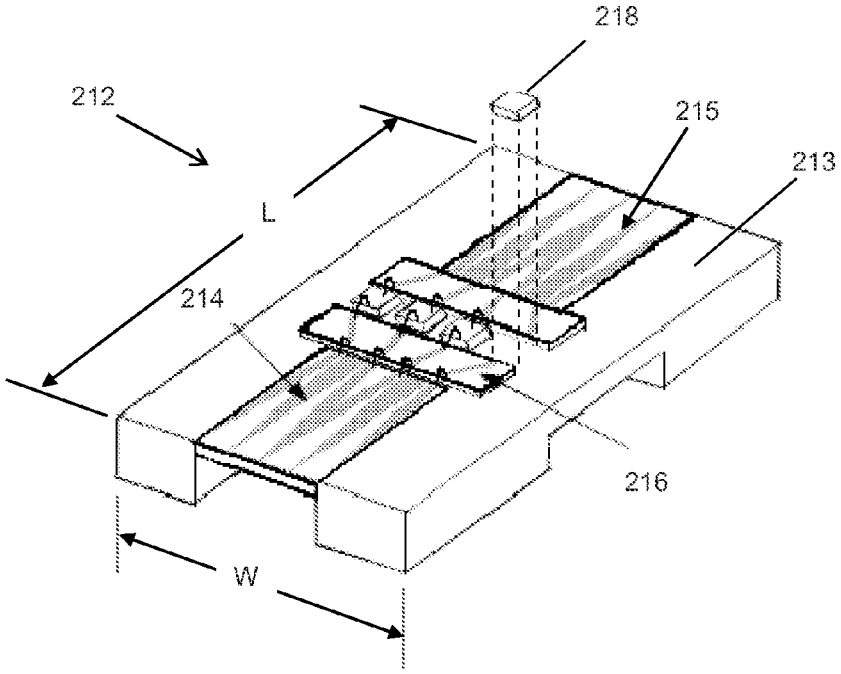
FIG. 5 illustrates a perspective view of an embodiment of an electromagnetic coupling module.

An illustrative embodiment of an electromagnetic coupling module 212 is shown in FIG. 5. The device includes a substrate 213 or similar supporting structure. The overall module 212 extends for an axial length L, also having a width W. The module 212 otherwise a relatively thin profile so as not to interfere with electromagnetic fields when positioned within a coaxial cavity. The module 212 further includes a first electromagnetic coupling device 215 facing along a first axial direction and a second coupling device 214 facing along a second axial direction. Each coupling device 214, 215 is configured to couple electromagnetic energy (e.g., and E-field) from/to its respective axial-facing direction, to/from an electronics module 218. The electronics module 218 can contain one or more of the signal conditioning elements discussed herein, such as gain adjusting (e.g., amplifying) and phase adjusting. One or more interface modules 216 can be provided, as needed, to all the electronics module 218 to couple to the first and second electromagnetic coupling devices 214, 215.

Figure 6:
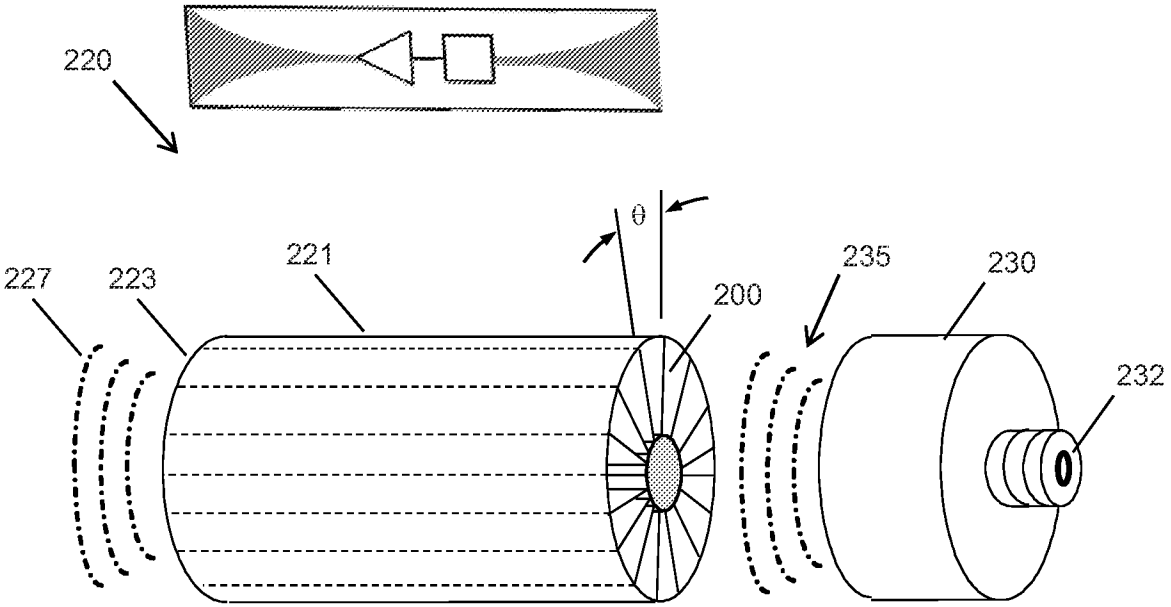
FIG. 6 illustrates a partially exploded, perspective view of an embodiment of an open-ended, radiating coaxial waveguide.

In some embodiments, the electromagnetic coupling module 200, 212 is substantially planar, for example, being fashioned on a printed circuit board, including microstrip, stripline, and the like. The coupling module is dimensioned to fit substantially within an open area of the coaxial cavity. In at least some embodiments, such substantially planar modules 200, 212 are aligned in a plane containing the longitudinal axis of the coaxial cavity, e.g., along a radius, with different modules being positioned similarly at respective radii. An example of a coaxial waveguide assembly 220 having sixteen such modules 200 is illustrated in FIG. 6. In this example embodiment, each module 200 is angularly displaced from its nearest neighbor by 22.5 degrees (i.e., 360°/16 modules). A tapered coaxial waveguide section 230 is shown in exploded view, removed from an end of a coaxial waveguide portion 221. The tapered section 230 is positioned opposite an open end 223, also having a coaxial input port 232. Electrical signals introduced at the input port 232 give rise to propagating electromagnetic waves (e.g., TEM) within the tapered section 230. The electric fields 235 interact with the electromagnetic coupling modules 200 in an arrangement referred to as a spatial feed. The coupling modules operate as described above, giving rise to amplified and at least for some modules 200, phase shifted representations of the electric field. The modified electric fields exit from the coaxial waveguide portion by way of the open end 233, giving rise to far-field radiation 227.

Figure 7:
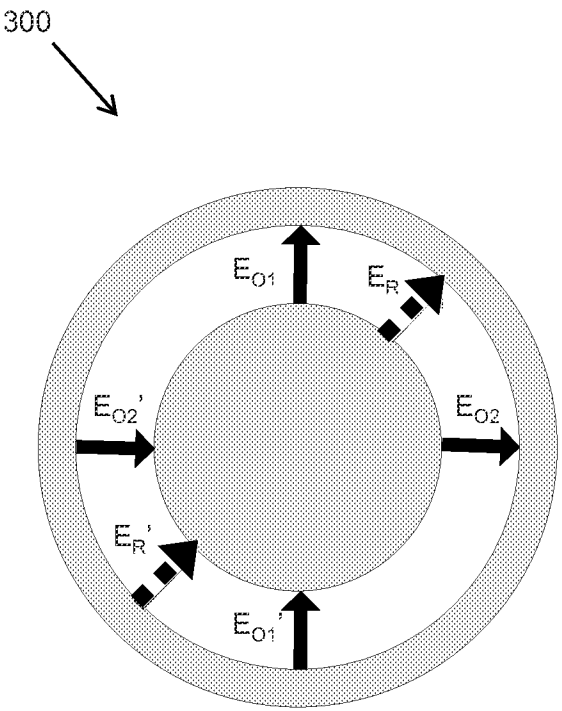
FIG. 7 illustrates a cross sectional view of an embodiment of a linearly polarized (e.g., 45°) quad-driven, open-ended, radiating coaxial waveguide.

The examples described thus far include diametrically opposing electromagnetic coupling modules (e.g., two modules residing in a common plane including the longitudinal axis, but disposed on either side of the center conductor. FIG. 7 illustrates a cross sectional view of an embodiment of a linearly polarized quad-driven, radiating coaxial waveguide assembly 300. The quad-drive assembly 300 includes four electromagnetic coupling modules (not shown, but each aligned with a respective on of the output electric field lines $E_{O1}$, $E_{O1}'$, $E_{O2}$, $E_{O2}'$, e.g., directly behind the field line).

In the illustrative example, a first pair of coupling modules reside in a first common plane including the longitudinal axis and giving rise to a first pair of electric fields $E_{O1}$, $E_{O1}'$, and a second pair of coupling modules reside an a second common plane also including the longitudinal axis giving rise to a second pair of electric fields $E_{O2}$, $E_{O2}'$, displaced from the first common plane by 90 degrees, as shown. The respective electric fields of each pair are in-phase, for example, as described above. The electric fields interact and give rise to resulting electric fields $E_R$ and $E_R'$ referred to as slant polarization, as illustrated in FIG. 7. In the illustrative example, with all contributing fields $E_{O1}$, $E_{O1}'$, $E_{O2}$, $E_{O2}'$ having substantially the same amplitude, the slant polarization occurs at approximately 45 degrees with respect to the respective first and second planes. Other polarizations are possible by varying one or more of amplitudes, phase offsets (e.g., from the electromagnetic coupling modules) and relative positions of the electromagnetic coupling modules.

Figure 8:
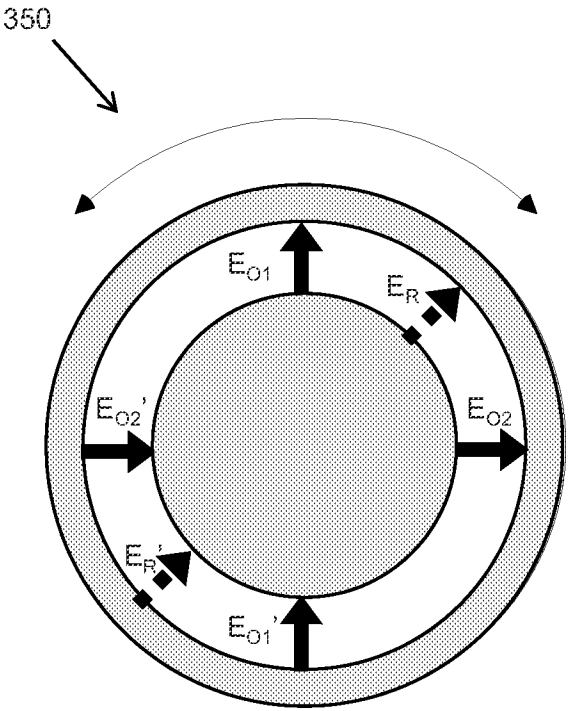
FIG. 8 illustrates a cross sectional view of an embodiment of an elliptically polarized (e.g., rotating electric field) quad-driven, open-ended, radiating coaxial waveguide.

FIG. 8 illustrates a cross sectional of an embodiment of an elliptically polarized quad-driven, radiating coaxial waveguide assembly 350. The quad-drive assembly 350 includes four electromagnetic coupling modules (not shown, but each aligned with a respective on of the output electric field lines $E_{O1}$, $E_{O1}'$, $E_{O2}$, $E_{O2}'$, e.g., directly behind the field line). As in the above example, a first pair of coupling modules reside in a first common plane including the longitudinal axis and giving rise to a first pair of electric fields $E_{O1}$, $E_{O1}'$, and a second pair of coupling modules reside an a second common plane also including the longitudinal axis giving rise to a second pair of electric fields $E_{O2}$, $E_{O2}'$, displaced spatially (i.e., rotationally) from the first common plane by 90 degrees, as shown. The respective electric fields of each pair are in-phase with each other (e.g., $E_{O1}$, $E_{O1}'$ are in phase and $E_{O2}$, $E_{O2}'$ are in phase) as described above. Additionally, a relative phase offset between the respective pairs of coupling modules is provided to induce a time-varying elliptical polarization. In at least some embodiments, each of the electromagnetic coupling modules provides a respective gain ($G_i$) and phase offset ($\phi_i$) to each of the electric fields. For example, such modifications can be represented by: $E_{01}=G_{1\phi1}E$; $E_{01}'=G_{1\phi1}E$; $E_{02}=G_{2\phi2}E$; and $E_{02}'=G_{2\phi2}E$. Circular polarization results when $G_1=G_2$ and $\Delta\phi=\phi_2-\phi1=+/-90°$ (the direction of rotation of the resulting electric field vector determined according to a sign of the phase difference). Slant polarization results when the change in phase angles is 0° or some multiple of +/−180°. Some form of elliptical polarization results from any other combination of G and $\phi$. For elliptical polarizations, the tip of the resulting electric field vector external to the waveguide assembly traces an elliptical pattern with respect to time.

Relative phase offsets can be accomplished, for example, by one or more of the phase shifting devices 210 (FIG. 4) or by the addition of another phase shifting device providing a relative phase offset between pairs of electrical fields. The electric fields similarly interact and give rise to resulting electric fields $E_R$ and $E_R'$ referred similar to the slant polarization, but different in that the slant angle of the resulting fields changes with time (i.e., rotates), as illustrated by the curved arrow above FIG. 8. Whether the rotation of the resulting electric fields is clockwise or counter-clockwise is determined by the sign of the relative phase difference. In the illustrative example, the polarization is circular with all of the contributing fields $E_{O1}$, $E_{O1}'$, $E_{O2}$, $E_{O2}'$ having substantially the same amplitude, with a relative phase difference between $E_{O1}$, $E_{O1}'$ and $E_{O2}$, $E_{O2}'$ of 90 degrees.

Figure 9:
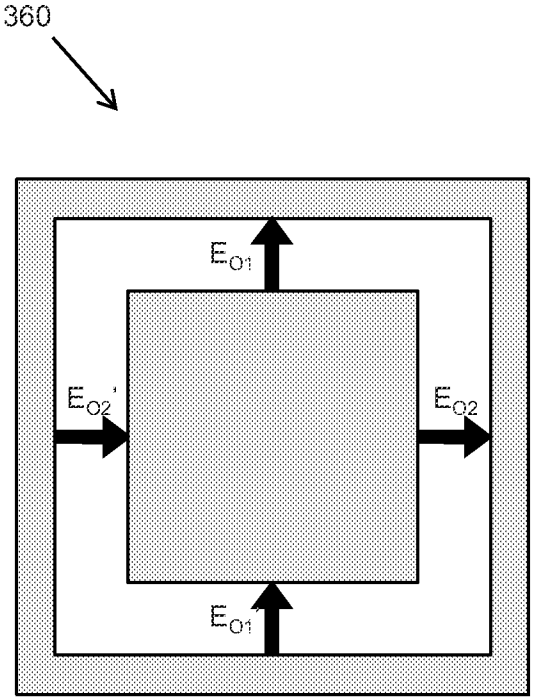
FIG. 9 illustrates a cross-sectional view of another embodiment of an open-ended, radiating coaxial waveguide.

In some embodiments, the waveguide assembly 150 depicted in the longitudinal cross section of FIG. 3, is circular, for example, as depicted in FIG. 2. In other embodiments, the waveguide is rectangular in cross section (e.g., square). Other waveguide cross-sectional shapes are contemplated including ellipses, polygons, and the like. FIG. 9 illustrates a cross sectional view of a square embodiment of a rectangular radiating coaxial waveguide assembly 360. The particular embodiment represents a linearly polarized quad-driven, radiating square coaxial waveguide assembly 360. As described above for circular coaxial waveguides, the rectangular quad-drive assembly 360 includes four electromagnetic coupling modules (not shown, but each aligned with a respective on of the output electric field lines $E_{O1}$, $E_{O1}'$, $E_{O2}$, $E_{O2}'$, e.g., directly behind the field line). In the illustrative example, a first pair of coupling modules reside in a first common plane including the longitudinal axis and giving rise to a first pair of electric fields $E_{O1}$, $E_{O1}'$, and a second pair of coupling modules reside an a second common plane also including the longitudinal axis giving rise to a second pair of electric fields $E_{O2}$, $E_{O2}'$, displaced from the first common plane by 90 degrees, as shown. Any transitional coaxial cavity can also follow the cross sectional shape of the coaxial waveguide (i.e., square).

Electronic components generally perform best over a finite bandwidth. For example, antennas as may be used in the transducers 202, 204 (FIG. 4) generally operate over a bandwidth that can be defined by its voltage-standing-wave-ratio (VSWR) response (e.g., frequencies at which the VSWR is below 2). Likewise, electronic components of the circuit module 206, such as the amplifier 208 and the phase adjuster 210 also perform best over finite bandwidths. An advantage of coaxial waveguides is its extremely wide bandwidth performance—generally greater than that of the transducers 202, 204 and perhaps even the electronic components. To better utilize the wide bandwidth capabilities of the coaxial waveguide, the component selection and/or construction can allow for dual-band, and more generally, multi-band operation.

Figure 10:
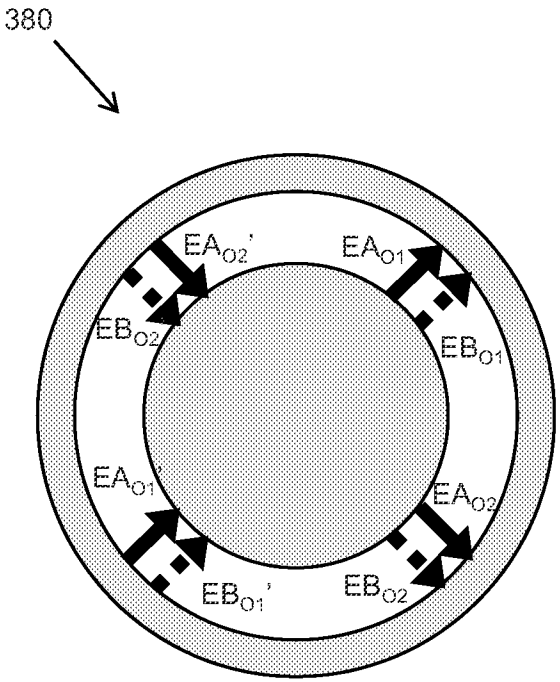
FIG. 10 illustrates a cross-sectional view of an embodiment of a dual-band, open-ended, radiating coaxial waveguide.

FIG. 10 illustrates a cross sectional view of an embodiment of a quad-driven, dual-band radiating coaxial waveguide assembly 380. The quad-drive assembly 380 includes four dual-band electromagnetic coupling modules (not shown, but each aligned with a respective one of the output electric field lines $EA_{O1}$, $EA_{O1}'$, $EA_{O2}$, $EA_{O2}'$, e.g., behind the field line). The "EA" fields refer to a first frequency band; whereas, the "EB" fields refer to a second frequency band. In some embodiments, the dual-band electromagnetic coupling modules are double-sided. For example, a dual-band module can be similar to that shown in FIG. 4, in that it has a first electronic circuit operating in the first frequency band, provided in electrical communication between a pair of opposing transducers also operating in the first frequency band. An electronic circuit can include one or more amplifiers and phase shifting devices adapted for operation in a first band. For dual band operation, one or more of the elements of the coupling module is provided in duplicate, with a difference being that the second be adapted for operation in the second frequency band. For example, in some embodiments, the electromagnetic coupling module is implemented on a dual side circuit board assembly. A first side, for example, similar to that shown in FIG. 4 operates in the first frequency band. The elements are substantially repeated on an opposite side, with the exception being that they are adapted for operation in the second frequency band. In other embodiments, two or more such coupling modules can be interlaced about the coaxial waveguide cavity, each opposing pair of modules configured to operate in a respective one of multiple operational frequency bands and/or polarizations.

In at least some embodiments of multi-band radiating coaxial assemblies, at least one of the individual frequency bands has a respective polarization different from another frequency band. For example, dual-band embodiments can have linearly polarized first and second frequency bands offset with respect to each other by 90 degrees. Other dual-band embodiments having circularly polarized frequency bands differing with respect to each other by their respective rotational sense (e.g., one frequency band having right-hand circular polarization and another frequency band having left-hand polarization). Other variations and combinations of polarization offsets for two or more frequency bands are possible.

Figure 11B:
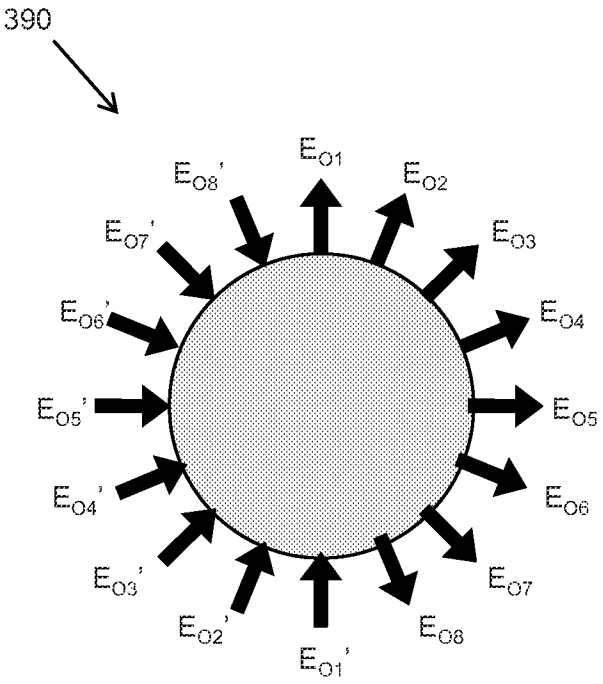
FIGS. 11A and 11B illustrate cross-sectional views of an embodiment of a multi-element driven, open-ended, radiating coaxial waveguide and the fields just beyond the outer conductor.
Figure 11A:
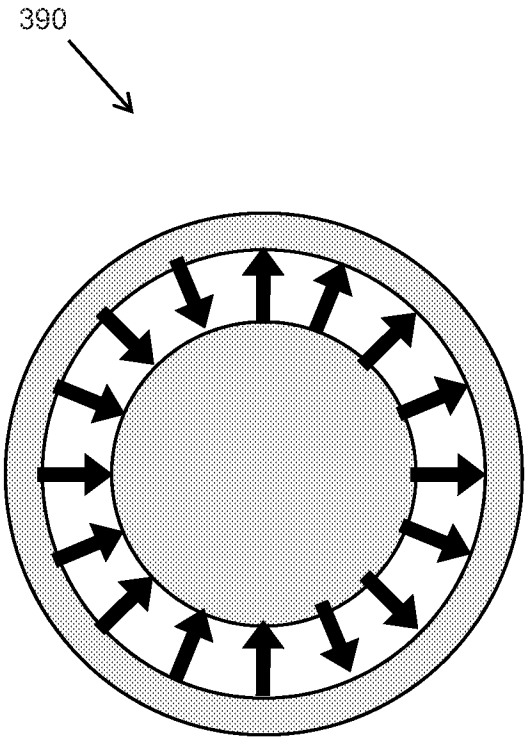

FIGS. 11A and 11B illustrate cross sectional views of an embodiment of a multi-driven, radiating coaxial waveguide assembly 390. The particular embodiment represents a linearly polarized sixteen coupling module coaxial waveguide assembly 360. The waveguide assembly 390 includes sixteen electromagnetic coupling modules (not shown, but each aligned with a respective on of the output electric field lines $E_{O1}$, $E_{O1}'$, $E_{O2}$, $E_{O2}'$ . . . , e.g., directly behind the field line). In the illustrative example, a first pair of coupling modules reside in a first common plane including the longitudinal axis and giving rise to a first pair of electric fields $E_{O1}$, $E_{O1}'$, and a second pair of coupling modules reside an a second common plane also including the longitudinal axis giving rise to a second pair of electric fields $E_{O2}$, $E_{O2}'$, displaced from the first common plane by 22.5 degrees, as shown. The pattern repeats for the sixteen modules considered in eight diametrically opposing pairs.

Figure 12:
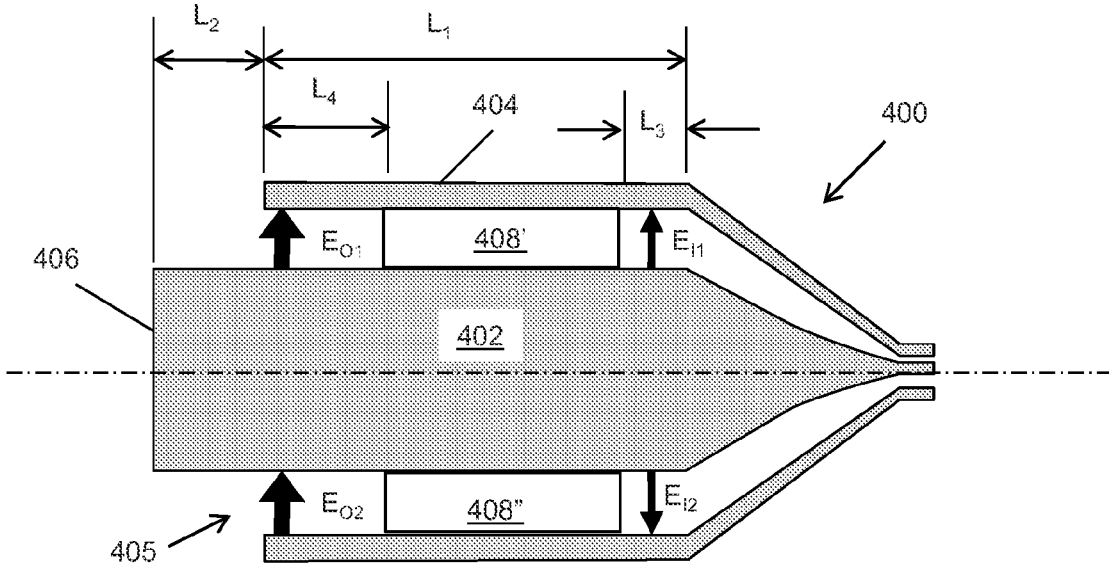
FIG. 12 illustrates longitudinal cross section of an embodiment of an open-ended, radiating coaxial waveguide with a protruding center conductor.

FIG. 12 illustrates longitudinal cross section of an embodiment of a radiating coaxial waveguide assembly 400 with a protruding, bluntly terminated center conductor 402. The structure is similar to that shown and described in relation to FIG. 3, in that it includes an coaxial waveguide portion 401, having a center conductor 402, such as a wire or cylinder and an outer conductor or shield 404 and terminating in an open end 405. The waveguide assembly 400 also includes a pair of electromagnetic coupling modules 408', 408" positioned between the outer and inner electrical conductors 402, 404 for coupling respective electric fields $E_{I1}$, $E_{I2}$. In addition to coupling electric fields, at least one of the coupling modules 408', 408" includes a phase-adjusting circuit, such that the coupled electric field of each coupling means of the pair of coupling means differs in phase with respect the other by approximately 180 degrees as illustrated by the respective conditioned electric fields $E_{O1}$, $E_{O2}$.

The outer shield 404 extends for a length $L_1$ measured from junction to a transitional coaxial waveguide to the open end 405. Each of the electromagnetic coupling modules 408', 408" (generally 408) is positioned at a length $L_3$ measured from a nearest end of the module 408 to the junction of the transitional coaxial waveguide. The modules 408 are also positioned at a length $L_4$ measured from a nearest end of the module 408 to the open end 405. In the illustrative example, the inner conductor 402 is terminated in a blunt end that extends a distance $L_2$ beyond the open end 405.

Figure 13:
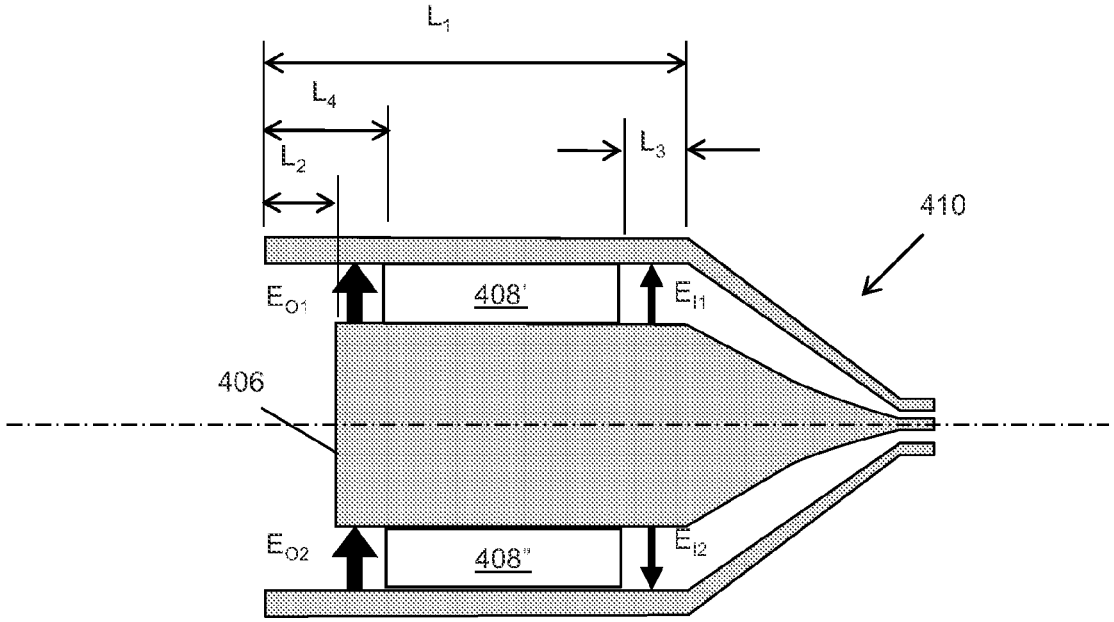
FIG. 13 illustrates longitudinal cross section of an embodiment of an open-ended, radiating coaxial waveguide with a recessed center conductor.

FIG. 13 illustrates longitudinal cross section of an embodiment of a radiating coaxial waveguide assembly 410 having a recessed, bluntly terminated center conductor 412. The dimensions are similar to the previous example in all regards, except that the center conductor 412 is terminated in a blunt end 416 that is recessed a distance $L_2$ from the open end 405.

Figure 14:
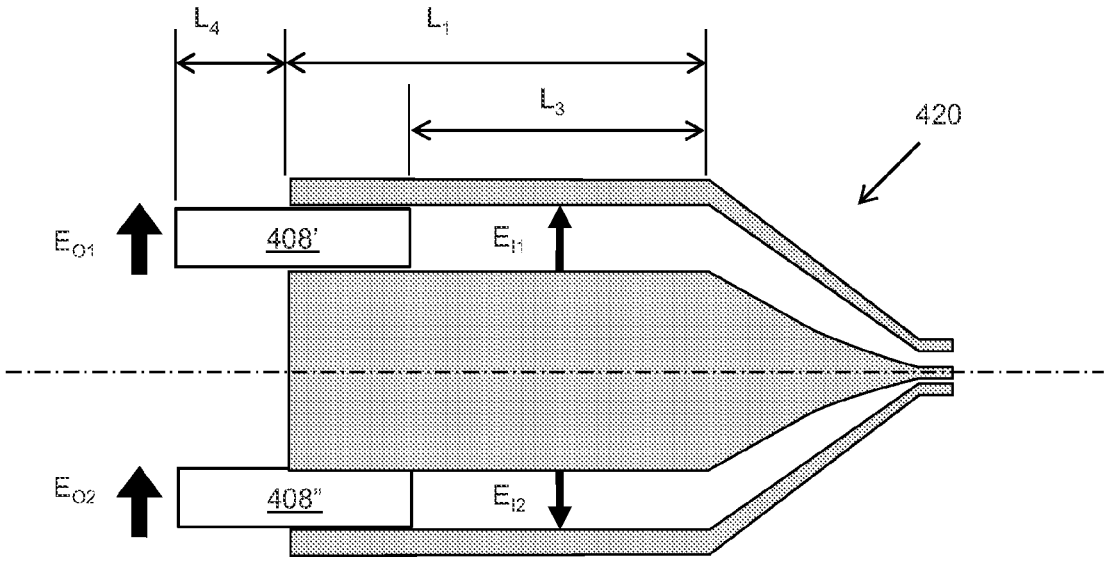
FIG. 14 illustrates longitudinal cross section of an embodiment of an open-ended, radiating coaxial waveguide with partially protruding electromagnetic coupling modules.

FIG. 14 illustrates longitudinal cross section of an embodiment of a radiating coaxial waveguide having protruding RF modules 408. The dimensions are similar to the previous example, except that the center conductor 422 is terminated in a blunt end 426 substantially at the open end 405. Another difference is that each of the electromagnetic coupling modules 408', 408" (generally 408) is positioned at a length $L_3$ measured from a nearest end of the module 408 to the junction of the transitional coaxial waveguide. The modules 408 are also positioned at a length $L_4$ measured from a nearest end of the module 408 to the open end 405, such that the opposite ends extend out from the open end 524 by a length $L_4$.

Figure 15:
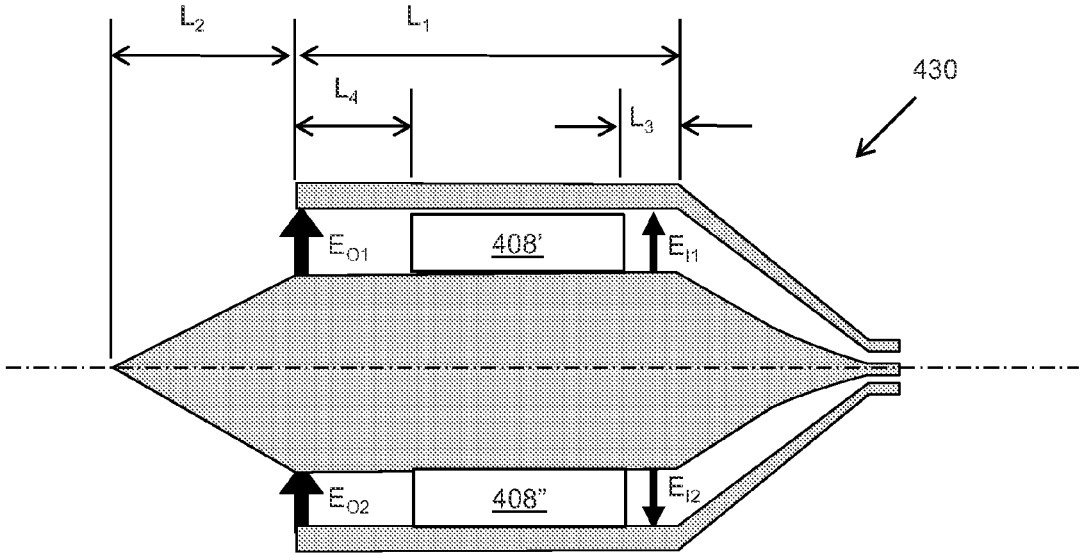
FIG. 15 illustrates longitudinal cross section of an alternative embodiment of an open-ended, radiating coaxial waveguide with a protruding center conductor.

FIG. 15 illustrates longitudinal cross section of an embodiment of a radiating coaxial waveguide assembly 430 with a protruding, conically terminated center conductor 432. The dimensions are similar to the previous example of FIG. 12, except that the center conductor 432 is terminated in a conical end 436 that protrudes a distance $L_2$ measured from the open end 405.

Figure 16:
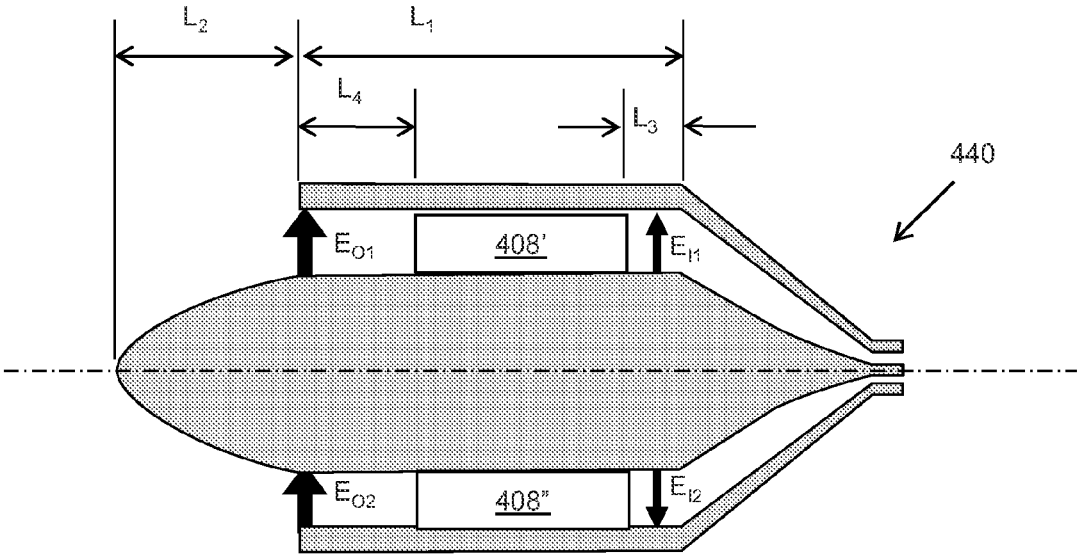
FIG. 16 illustrates longitudinal cross section of another alternative embodiment of an open-ended, radiating coaxial waveguide with a protruding center conductor.

FIG. 16 illustrates longitudinal cross section of an embodiment of a radiating coaxial waveguide assembly 440 having a protruding smooth terminated center conductor 442. The dimensions are similar to those of the previous example, except that the center conductor 432 is terminated in a smooth, e.g., parabolic end 436 that protrudes a distance $L_2$ measured from the open end 405.

Figure 17:
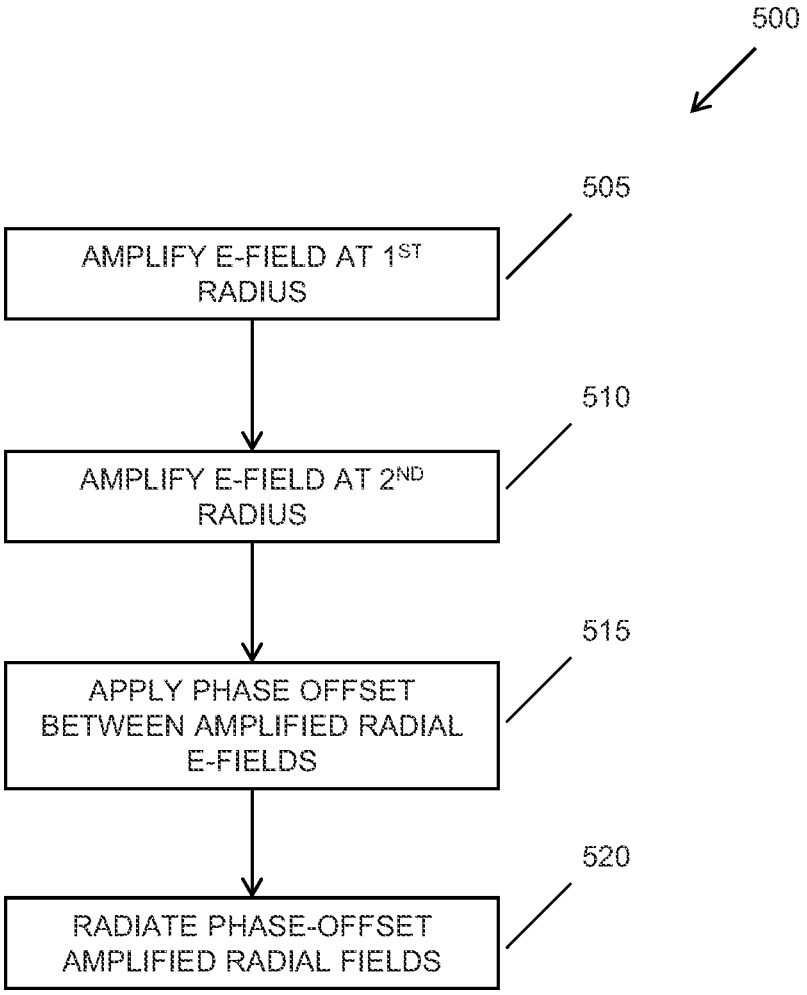
FIG. 17 illustrates a functional block diagram of an embodiment of a process for radiating energy from an open-ended coaxial cavity.

FIG. 17 illustrates a process 500 for efficiently radiating from the coaxial waveguide at least a portion of the transverse electro-magnetic (TEM) wave energy. The process includes amplifying an electric field, E-field, at 505, at a $1^{st}$ radius. In particular, the electric field corresponds to a sample of a coaxial electric field at the $1^{st}$ radius. The sampled field is obtained at a location within the coaxial cavity. A separate sample of the same coaxial E-field is obtained at $2^{nd}$ radius and amplified at 510. A phase offset is applied at 515, between amplified radial E-fields. The phase-offset amplified radial E-fields are radiated from the coaxial cavity at 520.

Figure 18B:
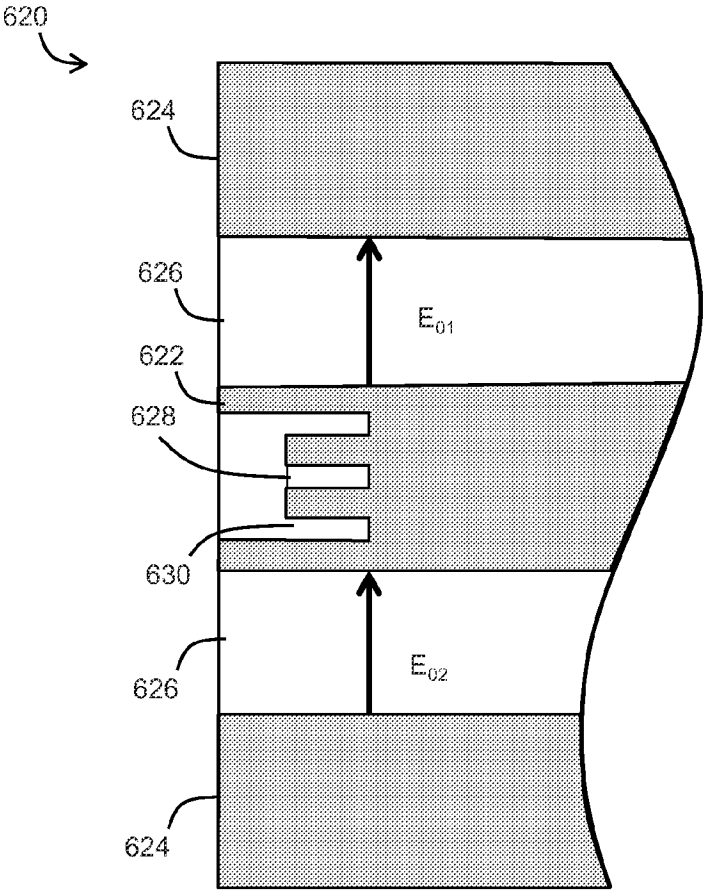
FIG. 18B illustrates longitudinal cross section of another embodiment of an open-ended, radiating coaxial waveguide with a central choke.
Figure 18A:
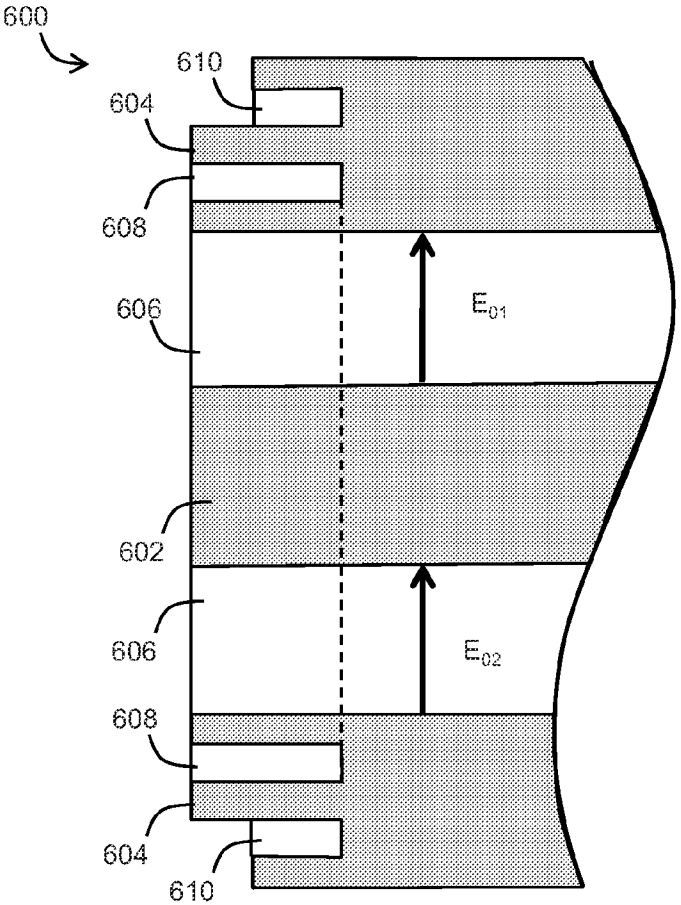
FIG. 18A illustrates longitudinal cross section of an embodiment of an open-ended, radiating coaxial waveguide with a peripheral choke.

FIG. 18A illustrates longitudinal cross section of an embodiment of an open-ended, radiating coaxial waveguide 600 with a peripheral choke 608, 610. The coaxial waveguide 600 includes a center conductor 602, such as a wire or cylinder and an outer conductor, or shield 604. The shield 604 is spaced apart from the center conductor 602 defining an open region 606 therebetween. When coaxial waveguide 600 is driven according to the techniques described herein, it sets up electromagnetic fields between the center conductor 602 and the shield 604 (e.g., $E_{01}$ and $E_{02}$) that combine constructively external to an open end of the waveguide 600. In this example, the outer conductor 604 is configured with a radio frequency choke. In particular, the choke includes two open ended axial grooves 608 and 610, each extending inward from the open end. An outer region of the outer conductor is also recessed with respect to the open end, such that the series of grooves 608, 610 have different dimensions (e.g., different depths). It is understood that one or more such RF choke features can be designed to reject RF energy of a desired band of wavelengths. In at least some embodiments, troughs of the one or more RF chokes 608, 610 extend around a perimeter of the coaxial waveguide 600. For example, open ended annular slots define the RF chokes 608, 610 of a cylindrical waveguide. In other embodiments, greater or fewer numbers of RF chokes 608, 610 are provided.

FIG. 18B illustrates longitudinal cross section of another embodiment of an open-ended, radiating coaxial waveguide 620 with a central choke. In the illustrative example, the central choke includes inner and outer open ended troughs 628, 630. In at least some embodiments, troughs of the one or more RF chokes 628, 630 extend around a longitudinal axis of the coaxial waveguide 620. For example, an open ended annular slot defines the outer RF choke 630 of a cylindrical waveguide; whereas, a central bore defines the inner RF choke 628. In other embodiments, greater or fewer numbers of RF chokes 628, 630 are provided. In at least some embodiments, one or more RF chokes can be provided on each of the inner and outer conductors of an open-ended, radiating coaxial waveguide.

Dimensions of any of the coaxial waveguides described herein are generally selectable, for example, based on target frequency band of operation, power levels, and the size of any electrical components that may be used in the electromagnetic modules. Certain devices, such as the transducers, electronic components, etc. have dimensions dictated by one or more of operational efficiencies, cost, and ease of manufacture. Choosing or being otherwise restricted to dimensional features of such components, a minimum dimension can be determined for the separation S between the inner and outer conductors of the waveguide. The overall dimensions of the waveguide can be determined for other performance reasons, such as a characteristic impedance $Z_0$. The characteristic impedance of a transmission line refers to a ratio of the amplitudes of voltage and current waves propagating along the line in the absence of reflections. Given minimum separation S and a characteristic impedance (e.g., 50Ω), the dimensions of the inner and outer conductors can be determined from any of a number of techniques well known to those familiar with transmission line theory. For at least some forms of transmission lines, such as cylindrical coaxial waveguides, a closed form solution for the characteristic impedance is defined in Eqn. 1 below.

$$Z_0 = \frac{138}{\sqrt{k}}\log\left(\frac{d_1}{d_2}\right) \qquad \text{Eqn. 1}$$

In this equation, $d_1$=inside diameter of outer conductor; $d_2$=outside diameter of inner conductor and k=dielectric constant of any insulation between conductors. From FIG. 2, the value of $d_2=d_1+2S$. This relationship requires that $d_2$ be greater than twice the chosen separation S. Thus, the relationship of Eqn. 1 can be used to control spacing along the tapered waveguide to preserve or otherwise control the characteristic impedance along the tapered waveguide (e.g., tapered waveguide 170 of FIG. 3). Maintaining substantially uniform characteristic impedance along a coaxial waveguide (e.g., coaxial waveguide portion 151 of FIG. 3), a tapered waveguide and a coaxial port (e.g., coaxial port 176 of FIG. 3) reduces reflections that would otherwise result from any mismatch. Such reflections are generally undesirable as they represent an inefficiency, although in most realizable systems, some mismatch is tolerable (e.g., an impedance mismatch contributing to a voltage standing wave ratio of no more than about 2:1). It is also worth noting that for any of the various open-ended, radiating coaxial waveguide embodiments discussed herein, and equivalents thereto, the outer conductor can extend along an electrically conducting surface away from the opening. For example, the coaxial opening can be defined in a conducting plane, such as a vehicular surface (e.g., an airframe or a hull).

One or more of the various modules described herein, such as the bias and control module 180 (FIG. 3) may represent or include any form of processing component, including general purpose computers, dedicated microprocessors, or other processing devices capable of processing electronic information. Examples of processors include digital signal processors (DSPs), application-specific integrated circuits (ASICs), field-programmable gate arrays (FPGAs), and any other suitable specific- or general-purpose processors. Although the examples described herein relate to particular embodiments of the modules, each module may include a respective processing component, or more generally, any suitable number of processors.

Any of the modules (e.g., the bias and control module 180) may include memory devices (e.g., RAM, ROM, hard disk drive, optical drive), for example, storing related processing values and or instructions. Any such memories may include any collection and arrangement of volatile or non-volatile components suitable for storing data. For example, any such memories may include random access memory (RAM) devices, read-only memory (ROM) devices, magnetic storage devices, optical storage devices, or any other suitable data storage devices. In particular embodiments, any such memories may represent, in part, computer-readable storage media on which computer instructions and/or logic are encoded. In such embodiments, some or all the described functionality of the various modules, e.g., the jitter error measurement modules, timing error detection modules, and error correction modules may be provided by a processor (not shown) executing the instructions encoded on the described media.

In general, each of the modules may represent any appropriate combination of hardware and/or software suitable to provide the described functionality. Additionally, any two or more of the modules may represent or include common elements.

The above-described systems and processes can be implemented in digital electronic circuitry, in computer hardware, firmware, and/or software. The implementation can be as a computer program product (i.e., a computer program tangibly embodied in an information carrier). The implementation can, for example, be in a machine-readable storage device and/or in a propagated signal, for execution by, or to control the operation of, data processing apparatus. The implementation can, for example, be a programmable processor, a computer, and/or multiple computers.

A computer program can be written in any form of programming language, including compiled and/or interpreted languages, and the computer program can be deployed in any form, including as a stand-alone program or as a subroutine, element, and/or other unit suitable for use in a computing environment. A computer program can be deployed to be executed on one computer or on multiple computers at one site.

Method steps can be performed by one or more programmable processors executing a computer program to perform functions of the invention by operating on input data and generating output. Method steps can also be performed by an apparatus and can be implemented as special purpose logic circuitry. The circuitry can, for example, be an FPGA (field programmable gate array) and/or an ASIC (application-specific integrated circuit). Modules, subroutines, and software agents can refer to portions of the computer program, the processor, the special circuitry, software, and/or hardware that implement that functionality.

Processors suitable for the execution of a computer program include, by way of example, both general and special purpose microprocessors, and any one or more processors of any kind of digital computer. Generally, a processor receives instructions and data from a read-only memory or a random access memory or both. The essential elements of a computer are a processor for executing instructions and one or more memory devices for storing instructions and data. Generally, a computer can include one or more mass storage devices for storing data (e.g., magnetic, magneto-optical disks, or optical disks). Alternatively or in addition, a computer can be operatively coupled to receive data from and/or transfer data to one or more such mass storage devices.

Data transmission and instructions can also occur over a communications network. Information carriers suitable for embodying computer program instructions and data include all forms of non-volatile memory, including by way of example semiconductor memory devices. The information carriers can, for example, be EPROM, EEPROM, flash memory devices, magnetic disks, internal hard disks, removable disks, magneto-optical disks, CD-ROM, and/or DVD-ROM disks. The processor and the memory can be supplemented by, and/or incorporated in, special purpose logic circuitry.

Comprise, include, and/or plural forms of each are open ended and include the listed parts and can include additional parts that are not listed. And/or is open ended and includes one or more of the listed parts and combinations of the listed parts.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

What is claimed is:

1. An open-ended coaxial waveguide antenna, comprising:

an inner electrically conducting surface having a substantially uniform cross section extending along a central axis;

an outer electrically conducting surface having a substantially uniform cross section extending along the central axis, the outer conductive surface spaced apart from and opposing the inner electrically conducting surface;

an open end defined substantially orthogonal to the central axis;

at least one pair of electromagnetic coupling modules, the modules of each of the at least one pair of electromagnetic coupling modules disposed at least partially within the open-ended coaxial waveguide antenna and aligned with respect to the other substantially on diametrically opposing radii of the open-ended coaxial waveguide antenna, wherein each electromagnetic coupling module of the at least one pair of electromagnetic coupling modules includes:

a first transducer and a second transducer adapted to i) convert a received first electromagnetic field to at least one of a voltage and a current signal, ii) amplify the at least one of the voltage and current signal, and iii) output a second electromagnetic field such that the second electromagnetic field propagates along the central axis in the direction of the open end; and an electronic circuit in electrical communication between the first and second transducers, the electronic circuit comprising a phase-adjusting element adapted to introduce a phase difference between each second electromagnetic field of each electromagnetic coupling module of each of the at least one pair of electromagnetic coupling modules such that the respective second electromagnetic fields constructively interact as they radiate from the open end of the open-ended coaxial waveguide antenna so as to form at least one far field radiating polarization mode in at least one frequency band.

2. The open-ended coaxial waveguide antenna of claim 1, wherein each of the transducers comprises a finline structure adapted for efficiently coupling a radial component of an electric field.

3. The open-ended coaxial waveguide antenna of claim 2, wherein each of the transducers is selected from the group consisting of: dipoles; loops; finlines; antipodal finlines; notch; travelling wave structures; and combinations thereof.

4. The open-ended coaxial waveguide antenna of claim 1, further comprising:

third and fourth electromagnetic coupling modules, each disposed at least partially within the coaxial waveguide antenna and along diametrically opposing radii arranged orthogonal to diametrically opposing radii of at least one subject pair of the at least one electromagnetic coupling modules, each of the third and fourth electromagnetic coupling modules comprising:

a respective pair of opposing transducers, each transducer adapted to convert between an electromagnetic field and at least one of a voltage and a current, wherein one of the opposing transducers outputs a third electromagnetic field propagating along the central axis in the direction of the open end, and a respective electronic circuit in electrical communication the respecting pair of transducers, at least one of the respective electronic circuits comprising a phase adjusting element introducing phase difference between the at least one of a voltage and a current of the third and fourth electromagnetic coupling modules such that the respective third electromagnetic fields constructively interact with the respective second electromagnetic fields as they radiate from the open end of the open-ended coaxial waveguide antenna so as to form the at least one far field radiating polarization mode in at least one frequency band.

5. The open-ended coaxial waveguide antenna of claim 4, wherein each phase adjusting element introduces a +/−90 degrees phase difference between the respective at least one of a voltage and a current of radially adjacent ones of the electromagnetic coupling modules.

6. The open-ended coaxial waveguide antenna of claim 1, wherein the electronic circuit includes an amplifier adapted to amplify a respective one of the at least one of a voltage and a current.

7. The open-ended coaxial waveguide antenna of claim 1, further comprising:

a coaxial transmission line port axially aligned with the coaxial waveguide; and an axially aligned, tapered coaxial waveguide coupled between one end of the open-ended coaxial waveguide and the coaxial transmission line port.

8. The open-ended coaxial waveguide antenna of claim 1, wherein a cross section of the open-ended coaxial cavity is substantially circular.

9. The open-ended coaxial waveguide antenna of claim 1, wherein the phase-adjusting element is selected from the group consisting of: reactance-based phase shifters; switched-line phase shifters; vector-modulator-based phase shifters; digital phase shifters; and combinations thereof.

10. The open-ended coaxial waveguide antenna of claim 1, further comprising an axial protrusion of the inner conducting surface extending beyond a terminal end of the outer conducting surface.

11. The open-ended coaxial waveguide antenna of claim 10, wherein a shape of the protrusion is selected from the group of shapes consisting of: cylinders; cones; paraboloids; truncated cones; truncated paraboloids; prisms; pyramids; and combinations thereof.

12. The open-ended coaxial waveguide antenna of claim 1, wherein the at least one far field radiating polarization mode comprises multiple distinct polarization modes.

13. The open-ended coaxial waveguide antenna of claim 1, wherein the at least one far field radiating polarization mode comprises a mode selected from the group consisting of circular, elliptical, slant and linear polarization.

14. The open-ended coaxial waveguide antenna of claim 1, wherein the at least one far field radiating polarization mode comprises multiple modes in distinct frequency bands.

15. A method for radiating electromagnetic energy, comprising:

amplifying selectively a first radial component of a transverse electromagnetic field within an open-ended coaxial waveguide;

amplifying selectively a second radial component of the transverse electromagnetic field, angularly offset from the first radial component;

applying a relative phase offset between the first and second amplified radial components of the transverse electromagnetic field; and directing each of the amplified radial components toward an open end of the open-ended coaxial waveguide, wherein the amplified radial components constructively interact so as to establish far-field radiation.

16. The method of claim 15, wherein the first and second radial components are selected along diametrically opposing radii, and wherein the act of applying a relative phase offset comprises applying a +/−180 degree offset between the first and second amplified radial components.

17. The method of claim 15, further comprising:

amplifying selectively a third radial component of the transverse electromagnetic field angularly offset from the first and second radial components;

amplifying selectively a fourth radial component of the transverse electromagnetic field angularly offset from the first, second and third radial components;

applying a relative phase offset between the third and fourth amplified radial components of the transverse electromagnetic field; and directing each of the amplified radial components toward an open end of the open-ended coaxial waveguide, wherein the amplified radial segments establish far-field radiation.

18. The method of claim 15, wherein the third and fourth radial components are selected along diametrically opposing radii, and applying a relative phase offset comprises applying a +/−180 degree offset between the first and second amplified radial components.

19. The method of claim 15, wherein applying the relative phase difference between the first and second electromagnetic coupling modules and applying the relative phase difference between the third and fourth electromagnetic coupling modules, comprises applying a relative phase difference between the first and the third electromagnetic coupling modules of approximately +/−90 degrees.

20. An antenna assembly, comprising:

means for amplifying selectively a first radial component of a transverse electromagnetic field within an open-ended coaxial waveguide;

means for amplifying selectively a second radial component of the transverse electromagnetic field, angularly offset from the first radial component;

means for applying a relative phase offset between the first and second amplified radial components of the transverse electromagnetic field; and means for directing each of the amplified radial components toward an open end of the open-ended coaxial waveguide, wherein the amplified radial components constructively interact so as to establish far-field radiation.

* * * * *